US005312710A

United States Patent [19]

Tomita et al.

[11] Patent Number: 5,312,710

[45] Date of Patent: May 17, 1994

[54] ELECTROPHOTOGRAPHIC TONER AND PROCESS FOR PRODUCING THE SAME

[75] Inventors: Kazufumi Tomita; Yoshihiro Inaba; Koichi Takashima; Tsutomu Kubo; Izuru Matsui, all of Ashigara, Japan

[73] Assignee: Fuji Xerox Co., Ltd., Tokyo, Japan

[21] Appl. No.: 906,423

[22] Filed: Jun. 30, 1992

[30] Foreign Application Priority Data

Jul. 4, 1991 [JP] Japan ..... 3-190673
Jul. 15, 1991 [JP] Japan ..... 3-200040

[51] Int. Cl.[5] ..... G03G 9/00; G03G 9/08

[52] U.S. Cl. ..... 430/109; 428/407; 430/110; 430/137; 430/138

[58] Field of Search ..... 430/108, 109, 110, 137, 430/138; 428/407

[56] References Cited

U.S. PATENT DOCUMENTS 4,745,030 5/1988 Arahara et al. ..... 428/421
5,037,716 8/1991 Moffat ..... 43/109
5,145,761 9/1992 Kubo et al. ..... 430/108

FOREIGN PATENT DOCUMENTS 58-66950 4/1983 Japan .
59-181358 10/1984 Japan .
60-126657 7/1985 Japan .
61-120160 6/1986 Japan .
63-177145 7/1988 Japan .
63-177147 7/1988 Japan .
63-177148 7/1988 Japan .

*Primary Examiner*—John Kight, III
*Assistant Examiner*—Shelley A. Dodson
*Attorney, Agent, or Firm*—Oliff & Berridge

[57] ABSTRACT

An electrophotographic toner comprising toner particles having adhered on the surface thereof a polymer comprising a monomer unit derived from a fluorine-containing vinyl monomer represented by formula (I) or (II):

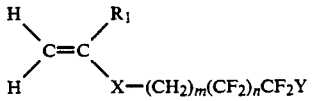

(I)

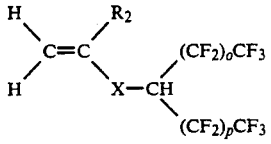

(II)

wherein X represents —COO—, —OCO—, —O—, or a p-phenylene group; $R_1$ and $R_2$ each represent a hydrogen atom or an alkyl group having from 1 to 3 carbon atoms; m represents an integer of from 1 to 7; n represents an integer of from 1 to 19; o and p each represent an integer of from 0 to 7; and Y represents a hydrogen atom or a fluorine atom.

The toner exhibits satisfactory charging stability against the environment or mechanical forces while having a narrow charge distribution. It can be prepared with a wide choice of materials and without requiring any special reaction apparatus.

14 Claims, No Drawings

ELECTROPHOTOGRAPHIC TONER AND PROCESS FOR PRODUCING THE SAME

FIELD OF THE INVENTION

This invention relates to a toner for developing an electrostatic latent image in electrophotography or electrostatic printing and a process for producing the same.

BACKGROUND OF THE INVENTION

A number of toners having on the surface thereof a fluorine-containing compound have been proposed for obtaining improved developing characteristics. For example, JP-A-58-66950 (the term "JP-A" as used herein means an "unexamined published Japanese patent application") discloses a capsule toner having an organic fluorine compound on the surface of capsules; JP-A-59-181358 discloses a capsule toner having a fluorine resin on the surface of capsules; JP-A-60-126657 discloses a capsule toner whose outer shell is formed by interfacial polymerization of a fluorine-containing compound; JP-A-61-120160 discloses a technique of imparting chargeability to toner particles which comprises reacting a fluorine-containing alcohol with a carboxyl group or an isocyanate group present on the outer shell of the particles; and JP-A-63-177145, JP-A-63-177147 and JP-A-63-177148 disclose a capsule toner having formed on the outer shell thereof a high-molecular chain by graft polymerization of a compound having a fluorine atom as a charge control group.

However, none of these toners proposed to date is sufficiently satisfactory due to the respective disadvantage described below.

The toner disclosed in JP-A-58-66950 has dependence of chargeability on the environmental condition, particularly humidity because the organic fluorine compound present on the capsule surface contains not only a fluorine-containing hydrophobic group but a hydrophilic group.

The fluorine resin disclosed in JP-A-59-181358 is a homo- or copolymer having a structure like a hydrocarbon with its hydrogen atom displaced with a fluorine atom and therefore has poor adhesion to the outer shell and easily releases therefrom.

When the technique of JP-A-60-126657 is followed, one encounters with difficulty in obtaining both mechanical properties of the outer shell and chargeability of the toner as a whole from the same outer shell-forming material. In other words, there is involved the problem of narrow choice of materials in the production.

According to the invention disclosed in JP-A-61-120160 where an outer shell is formed by interfacial polymerization, since either a carboxyl group or an isocyanate group is a functional group participating in interfacial polymerization, it is difficult to make such a group present on the surface of the outer shell. Further, since the reaction between this functional group and an alcohol does not sufficiently proceed in an aqueous solution, there is no means but to use an organic solvent. As a result, an apparatus for solvent recovery is required, and the equipment should be proof against explosion, which incur cost.

In JP-A-63-177145, JP-A-63-177147, and JP-A-63-177148, vinyl fluoride is the only example given as a grafting monomer containing a fluorine atom. Moreover, vinyl fluoride is gaseous at room temperature and requires a special reaction apparatus to be grafted to the capsule surface.

Apart from the use of a fluorine-containing compound, it has been proposed to maintain charging stability of a toner by using a metal complex salt, etc. However, it is difficult to control dispersibility of a metal complex salt in a toner composition. Besides, most of metal complex salts are inapplicable to color toners because of their own color.

Having studied on negative chargeability of microcapsule toners, the inventors previously proposed to adhere a polymer comprising a specific fluorine-containing vinyl monomer to the capsule surface (JP-A-3-220561). However, the capsule toner having a fluorine-containing polymer on the surface thereof as disclosed in JP-A-3-220561 proved to undergo deterioration in electrophotographic image quality. This is because core-forming fine particles of low electrical resistance, such as a magnetic powder, carbon black and a pigment, are completely covered with an insulating capsule wall and the fluorine-containing polymer is also insulating so that charge exchange among capsule toner particles is hindered, resulting in broadening of charge distribution.

In addition, the conventional capsule toners have insufficient cleaning properties and they tend to remain unremoved from a photoreceptor under a low temperature and low humidity condition. In general, a toner having a capsule structure is required to have improved cleaning properties so as to clean a photoreceptor without imposing a large stress on the toner particles. In this connection, the conventional capsule toners were insufficient.

SUMMARY OF THE INVENTION

An object of the present invention is to provide a toner, especially a capsule toner which exhibits satisfactory charging stability against the environment, which shows a narrow charge distribution, which suffers from no impairment of chargeability due to mechanical forces, and which can be prepared with a wide choice of materials allowed and without requiring any special reaction apparatus.

Another object of the present invention is to provide a capsule toner which has satisfactory cleaning properties even in a low temperature and low humidity condition.

The present invention relates to an electrophotographic toner comprising toner particles having adhered on the surface thereof a polymer comprising a monomer unit derived from a fluorine-containing vinyl monomer represented by formula (I) or (II):

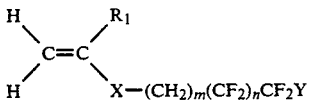

(I)

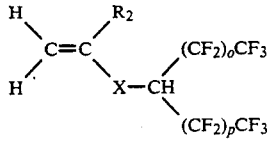

(II)

wherein X represents —COO—, —OCO—, —O—, or a p-phenylene group; $R_1$ and $R_2$ each represent a hydrogen atom or an alkyl group having from 1 to 3 carbon atoms; m represents an integer of from 1 to 7; n represents an integer of from 1 to 19; o and p each represent an integer of from 0 to 7; and Y represents a hydrogen atom or a fluorine atom.

DETAILED DESCRIPTION OF THE INVENTION

The toner particles according to the present invention include those composed of toner-forming materials alone and those having a so-called capsule structure.

In the present invention, toner particles having a substance capable of forming a radical on the surface thereof are preferred. The terminology "a substance capable of forming a radical" as used herein means a substance which undergoes a hydrogen pull reaction or a hydrogen addition reaction with a monomer radical or a cerium ion (IV). Examples of such a radical-forming substance include polymers, such as polyamide, polyurea, polyurethane, polyester, polyvinyl acetate, polyvinyl alcohol, cellulose, synthetic rubbers, styrene polymers, (meth)acrylate copolymers, epoxy resins, phenoxy resins, and acrylic resins, and mixtures thereof. The terminology "having on the surface" as used herein means that the radical-forming substance is uniformly present either on the entire surface of the toner particles or in spots.

Where the toner particles are composed of toner-forming materials alone, they may contain therein a colorant. Examples of suitable colorants include inorganic pigments, such as carbon black, red oxide, Prussian blue, and titanium oxide; azo pigments, such as Fast Yellow, Disazo Yellow, Pyrazolone Red, Chelate Red, Brilliant Carmine, and Para Brown; phthalocyanine pigments, such as Cu-phthalocyanine and metal-free phthalocyanine; and condensed polycyclic pigments, such as Flavanthrone Yellow, Dibromoanthrone Orange, Perylene Red, Quinacridone Red, and Dioxane Violet. Disperse dyes and oil-soluble dyes may also be employed. A part or the whole of a black colorant may be replaced with a magnetic powder to provide a magnetic one-component toner. Examples of usable magnetic powders include magnetite, ferrite, and a single metal (e.g., cobalt, iron, nickel) or an alloy thereof. The magnetic powder may be surface treated with a coupling agent, such as a silane coupling agent and a titanate coupling agent, or an oil-soluble surface active agent, or may be coated with an acrylic resin, a styrene resin, or an epoxy resin. Further, the colorant or magnetic powder incorporated as a component of a core material may be present on the interface between the core and the outer shell or in the outer shell after capsule formation.

Where the toner particles have a capsule structure, resin materials constituting the capsule wall preferably include polyurea resins, polyurethane resins, polyamide resins, polyester resins, epoxy resins, epoxyurea resins, and epoxyurethane resins. More preferred of them are a polyurea resin, a polyurethane resin, a mixture of a polyurea resin and a polyurethane resin, an epoxyurea resin, an epoxyurethane resin, and a mixture of an epoxyurea resin and an epoxyurethane resin.

It is preferable to change the thickness of the outer shell of a capsule toner depending on whether it is for pressure fixing or heat fixing. It is also preferable to change the kind or compounding ratio of constituent components according to the fixing system. The core substance of pressure-fixable capsule toners is mainly composed of a pressure-sensitive component, and that of heat-fixable capsule toners is mainly composed of a heat-sensitive component. For pressure fixing, in particular, a core substance mainly composed of a binder resin, a high-boiling solvent capable of dissolving the binder resin, and a colorant, or a core substance mainly composed of a soft solid substance and a colorant is preferred. If desired, the colorant may be replaced with a magnetic powder, or the core substance may further contain additives, such as a silicone oil, for improvement in fixing properties. A high-boiling solvent incapable of dissolving a binder resin may be used in combination with the high-boiling solvent capable of dissolving a binder resin. The colorant which can be used in capsule toners is the same as described above.

Any of resins known for toner fixing can be used as a binder resin of the core substance. Examples of suitable binder resins include acrylate copolymers, such as polymethyl acrylate, polyethyl acrylate, polybutyl acrylate, poly-2-ethylhexyl acrylate, and polylauryl acrylate; methacrylate copolymers, such as polymethyl methacrylate, polybutyl methacrylate, polyhexyl methacrylate, poly-2-ethylhexyl methacrylate, and lauryl polymethacrylate; acrylatemethacrylate copolymers; styrene (or a derivative thereof)(meth)acrylate copolymers; polyvinyl acetate; polyvinyl propionate; polyvinyl butyrate; olefinic homo- or copolymers, such as polyethylene and polypropylene; styrene copolymers, such as a styrene-butadiene copolymer, a styrene-isoprene copolymer, and a styrene-maleic acid copolymer; polyvinyl ether; polyvinyl ketone; polyester; polyamide; polyurethane; rubbers; epoxy resins; polyvinyl butyral; rosin; modified rosin; terpene resins; and phenol resins. These binder resins may be used either individually or in combinations thereof. The binder resin may be formed by polymerization after completion of encapsulation.

The soft solid substance which can be used as a core substance of pressure-fixable capsule toners is not particularly limited as long as it has softness and fixability at room temperature, but a polymer having a glass transition temperature of from −60° to 5° C. or a polymer blend containing such a polymer is preferred.

The high-boiling solvent capable of dissolving a binder resin include oil-soluble solvents having a boiling point of 140° C. or higher, and preferably 160° C. or higher. A high-boiling solvent to be used may be selected from those described under the head of "Plasticizers" in *Modern Plastics Encyclopedia* (1975–1976) or those known as a core substance of pressure-fixable capsule toners disclosed, e.g., in JP-A-58-145964 and JP-A-63-163373. Examples of usable high-boiling solvents are phthalic esters (e.g., diethyl phthalate, dibutyl phthalate), aliphatic dicarboxylic acid esters (e.g., diethyl malonate, dimethyl oxalate), phosphoric esters (e.g., tricresyl phosphate, trixylyl phosphate), citric esters (e.g., o-acetyl triethyl citrate), benzoic esters (e.g., butyl benzoate, hexyl benzoate), fatty acid esters (e.g., hexadecyl myristate, dioctyl adipate, linseed oil, castor oil, perilla oil), alkylnaphthalenes (e.g., methylnaphthalene, dimethylnaphthalene, monoisopropylnaphthalene, diisopropylnaphthalene), alkyldiphenyl ethers (e.g., o-, m-, or p-methyldiphenyl ether), higher fatty acid amides or aromatic sulfonic acid amides (e.g., N,N-dimethyllauramide, N-butylbenzenesulfonamide), trimellitic esters (e.g., trioctyl trimellitate), diarylalkanes (e.g., diarylmethanes, e.g., dimethylphenylphenylmethane, and diarylethanes, e.g., 1-phenyl-1-methylphenylethane, 1-dimethylphenyl-1-phenylethane, 1-ethylphenyl-1-phenylethane), saturated aliphatic hydrocarbons, unsaturated aliphatic hydrocarbons, and chlorinated paraffins.

In the production of capsule toners, while the method of encapsulation is not particularly limited, encapsulation by interfacial polymerization is especially preferred from the standpoint of sufficient covering and satisfactory mechanical strength of the outer shell formed. Any known interfacial polymerization technique can be utilized. For example, encapsulation of one component of a core substance can be carried out by a method in which other core-forming components previously having been polymerized are charged together with a low-boiling solvent and an outer shell-forming component(s) and interfacial polymerization is conducted to form an outer shell or a method in which an outer shell-forming monomer(s) is interfacial polymerized to form an outer shell and then a core-forming monomer(s) is polymerized to form a core. For the details, reference can be made, e.g., to JP-A-57-179860, JP-A-58-66948, JP-A-59-148066, and JP-A-59-162562.

The polymer which is adhered onto the surface of toner particles essentially comprises a monomer unit derived from a fluorine-containing vinyl monomer represented by formula (I) or (II).

Specific examples of suitable monomers of formula (I) or (II) are pentafluoropropyl acrylate, pentafluoropropyl methacrylate, pentafluorooctyl methacrylate, pentafluorooctyl acrylate, nonafluoropentyl acrylate, nonafluoropentyl methacrylate, 1,1,1,3,3,3-hexafluoroisopropyl acrylate, 1,1,1,3,3,3-hexafluoroisopropyl methacrylate, tetrafluoropropyl methacrylate, tetrafluoropropyl acrylate, hexafluoropentyl methacrylate, and hexafluoropentyl acrylate. Particularly preferred of them are pentafluoropropyl methacrylate and 1,1,1,3,3,3-hexafluoroisopropyl acrylate.

The polymer may be a homopolymer prepared from the monomer of formula (I) or (II) or a copolymer prepared from the monomer of formula (I) or (II) and other copolymerizable vinyl monomer(s). Suitable copolymerizable vinyl monomers include (meth)acrylic esters, e.g., methyl (meth)acrylate, ethyl (meth)acrylate, propyl (meth)acrylate, butyl (meth)acrylate, pentyl (meth)acrylate, hexyl (meth)acrylate, lauryl (meth-)acrylate, cyclohexyl (meth)acrylate, 2-ethylhexyl (meth)acrylate, benzyl (meth)acrylate, hydroxyethyl (meth)acrylate, hydroxypropyl (meth)acrylate, 2-ethoxyethyl (meth)acrylate, glycidyl (meth)acrylate, and phenyl (meth)acrylate; vinyl-containing cyano compounds, e.g., acrylonitrile, methacrylonitrile, and cyanostyrene; fatty acid vinyl esters, e.g., vinyl formate, vinyl acetate, vinyl propionate, vinyl butyrate, vinyl trimethylacetate, vinyl caproate, vinyl caprylate, and vinyl stearate; vinyl ethers, e.g., ethyl vinyl ether, propyl vinyl ether, butyl vinyl ether, hexyl vinyl ether, 2-ethylhexyl vinyl ether, and phenyl vinyl ether; vinyl ketones, e.g., methyl vinyl ketone and phenyl vinyl ketone; and vinyl aromatic compounds, e.g., styrene, chlorostyrene, hydroxystyrene, and $\alpha$-methylstyrene.

The copolymer must comprise at least 5 mol %, preferably 10 mol % or more, of the fluorine-containing vinyl monomer of formula (I) or (II). If the content of the monomer (I) or (II) is less than 5 mol %, the polymer fails to produce sufficient effects on reducing the environment dependency of chargeability.

The polymer preferably has a degree of polymerization of from 20 to 2000, and more preferably from 100 to 500. The polymer is preferably present on the surface of the toner particles in an amount of from 0.1 to 20 parts by weight per 100 parts by weight of the toner particles.

The terminology "adhered" as used for the above-described polymer means that the polymer is bonded to the surface of toner particles through either a physical means or a chemical means so that it is not released therefrom on carrying out development. While adhesion of the polymer to the toner particles may be effected by various methods, chemical bonding by, for example, graft polymerization is particularly preferred for obtaining sufficient adhesion.

Graft polymerization is suitably carried out by (a) a process comprising redox polymerizing a fluorine-containing vinyl monomer of formula (I) or (II) or a mixture of the monomer of formula (I) or (II) and other copolymerizable monomer on the toner particles in the presence of cerium (IV) or (b) a process comprising graft polymerizing a monomer having at least two radical chain transfer groups on the toner particles having thereon a radical-forming substance in the presence of cerium (IV) and then radical polymerizing a fluorine-containing vinyl monomer of formula (I) or (II) or a mixture of the monomer of formula (I) or (II) and other copolymerizable monomer in the presence of a radical polymerization initiator, e.g., a peroxide or an azo compound, or a redox polymerization initiator composed of a peroxide and a reducing agent. For the details of graft polymerization using Ce (IV), refer to Ide Fumio *Graft JUGO TO SONO OYO* (*Graft Polymerization And The Application*), published by KOBUNSHI KANKOKAI.

The radical polymerization initiator which can be used in process (b) includes hydrogen peroxide, potassium persulfate, ammonium peroxodisulfate, an alkyl hydroperoxide, a dialkyl peroxide, a diacyl peroxide, an ester peroxide, and an azo compound. The redox polymerization initiator which can be used in process (b) includes combinations of a peroxide selected from a persulfate, hydrogen peroxide, a hydroperoxide, etc. and a reducing agent selected from various kinds, such as hydrogen peroxide/a ferrous salt, benzoyl peroxide/-dimethylaniline, and potassium persulfate/$NaHSO_3$.

The grafting monomer having at least two radical chain transfer groups which can be used in process (b) include poly(meth)acrylates of polyhydric alcohols, such as ethylene glycol diacrylate, ethylene glycol dimethacrylate, diethylene glycol dimethacrylate, trimethylolpropane triacrylate, and pentaerythritol dimethacrylate; compounds having at least two acryl groups which are obtained by the reaction between acrylic acid and an amine; polyvinyl ethers of polyhydric alcohols, such as ethylene glycol divinyl ether; polyvinyl esters of polycarboxylic acids, such as divinyl succinate and divinyl phthalate; and aromatic compounds having at least two vinyl groups, such as divinylbenzene and p-allylstyrene. The grafted polymer chain formed by these monomers having at least two radical chain transfer groups preferably amounts to 0.05 to 10% by weight based on the toner particle.

In addition to the above-described chemical bonding, adhesion of the polymer onto the toner particles may also be performed physically by, for example, a process comprising dispersing toner particles in a solution or dispersion of the polymer and spray drying the resulting solution or dispersion.

It is preferable that the capsule toner according to the present invention has adhered on the surface thereof conductive fine particles.

The conductive fine particles which can be used in the present invention include those having an electric resistivity of not more than about $10^8$ Ωcm, and preferably not more than $10^5$ Ωcm. Preferred of them are fine powders of electron-conductive materials having small humidity dependence of electric conductivity, such as carbon, e.g., carbon black and graphite; metals, e.g., copper, gold, and silver; metal oxides, e.g., zinc oxide, titanium oxide, tin oxide, aluminum oxide, indium oxide, silicon oxide, magnesium oxide, barium oxide, molybdenum oxide, iron oxide, and tungsten oxide; metal oxides doped with a metal (e.g., antimony); and composite oxides thereof. Particularly preferred are fine particles of carbon black, tin oxide, or titanium oxide. These conductive fine particles have a particle size of not more than 2 μm, and preferably not more than 0.5 μm.

The conductive fine particles are preferably added in an amount of from 0.01 to 5 parts by weight, and more preferably from 0.05 to 1 part by weight, per 100 parts by weight of capsule toner particles. If the amount of the conductive fine particles to be added is too large, the toner loses its chargeability. If it is too small, the charge distribution of the toner tends to become broad.

The conductive fine particles can be adhered onto the surface of capsule toner particles by dry blending with the capsule toner in a twin-cylinder mixer, a Henschel mixer, etc. or dispersing in an aqueous suspension of the capsule toner followed by spray drying or drying in an oven.

In order to endow a capsule toner with fluidity or chargeability, other external additives other than the above-described conductive fine particles, such as silicon oxide, may further be added to the surface of a capsule toner. Addition of the external additive can be conducted by dry blending in a mixing machine, e.g., a twin-cylinder mixer or a Henschel mixer, or by adding an aqueous dispersion of the additive in water or an aqueous medium (e.g., water-alcohol) to a slurry of the capsule toner followed by drying.

The capsule toner has an average particle size of from 4 to 30 μm, and preferably from 6 to 18 μm.

The present invention is now illustrated in greater detail with reference to the examples, but it should be understood that the present invention is not construed as being limited thereto. All the parts and percents are given by weight unless otherwise indicated.

EXAMPLE 1

1) Preparation of Capsule Particles

In a mixture of 60 g of dibutylnaphthalene and 60 g of ethyl acetate were dissolved 30 g of polyisobutyl methacrylate (weight-average molecular weight (Mw): $16\times10^4$) and 40 g of a styrene-n-butyl methacrylate copolymer (Mw: $6\times10^4$). To the solution was added 120 g of a magnetic powder ("EPT-1000" produced by Toda Kogyo Corp.), and the mixture was dispersed in a ball mill for 16 hours. To 200 g of the resulting dispersion were added 30 g of an isocyanate compound ("Sumidur L" produced by Sumitomo Bayer Urethane Co., Ltd.) and 24 g of ethyl acetate, followed by thoroughly mixing. The resulting dispersion was designated liquid A.

Separately, 10 g of hydroxypropylmethyl cellulose ("Metolose 65SH50" produced by Shin-Etsu Chemical Co., Ltd.) was dissolved in 200 g of deionized water, and the solution was cooled to 5° C. The resulting solution was designated liquid B.

Liquid B was agitated in an emulsifier ("Autohomomixer" manufactured by Tokukikako K.K.), and liquid A was slowly poured therein to conduct emulsification thereby to obtain an O/W emulsion having oil droplets of about 12 μm in average size. The emulsion was transferred to a stirrer equipped with a propeller stirring blade ("Three-One Motor" manufactured by Shinto Kagaku Co., Ltd.) and stirred at 400 rpm for 10 minutes. To the mixture was added dropwise 100 g of a 5% aqueous solution of diethylenetriamine, and the mixture was then heated to 60° C. to conduct an encapsulation reaction for 3 hours. After completion of the reaction, the reaction system was poured into 2 l of deionized water, and the mixture was stirred thoroughly, followed by allowing to stand. After the capsule particles precipitated, the supernatant liquor was removed. The above-mentioned washing operation was repeated 7 more times to finally recover capsule particles containing an oily binder. Deionized water was added to the capsule particles to prepare an aqueous capsule suspension having a solid content of 40%.

2) Preparation of Toner

To 125 g of the capsule suspension prepared in (1) above (capsule particles content: 50 g) was added 125 g of deionized water, and the mixture was stirred in a propeller stirrer "Three-One Motor" at 200 rpm. To the mixture were added 5 g of 1N nitric acid, 4 g of a 10% aqueous solution of cerium sulfate, and then 0.5 g of ethylene glycol dimethacrylate, and the mixture was allowed to react at 15° C. for 3 hours. After completion of the reaction, the reaction mixture was poured into 1 l of deionized water, thoroughly stirred, and allowed to stand. After the capsule particles precipitated, the supernatant liquor was removed. This washing operation was repeated 2 more times to finally recover capsule particles in which ethylene glycol dimethacrylate was graft polymerized to the surface of the outer shell. The resulting capsule particles were re-suspended in deionized water and stirred in a propeller stirrer "Three-One Motor" at 200 rpm. Then, 0.4 g of potassium persulfate, 1 g of pentafluoropropyl methacrylate, and 0.16 g of sodium hydrogensulfite were successively added thereto, and the mixture was allowed to react at 25° C. for 3 hours. After completion of the reaction, the reaction mixture was poured into 2 l of deionized water, thoroughly stirred, and allowed to stand. After the capsule particles were sedimented, the supernatant liquor was removed. This washing operation was repeated 4 more times to finally recover a capsule toner in which pentafluoropropyl methacrylate was graft polymerized to the surface of the outer shell. The resulting capsule suspension was spread in a stainless steel tray and dried in a drier (manufactured by Yamato Kagaku Co., Ltd.) at 60° C. for 10 hours.

3) Evaluation Test

Three grams of the resulting capsule toner and 100 g of a phenol resin-coated iron powder carrier were mixed at 20° C. and 50% RH. The amount of electricity of the capsule toner was −19 μC/g as measured by a blow-off method. When the mixing was conducted at 28° C. and 80% RH, the amount of electricity was −17 μC/g.

On the other hand, 1 part of hydrophobic silica ("R 972" produced by Nippon Aerosil K.K.) was added to 100 parts of the capsule toner, followed by thoroughly mixing. The thus prepared toner was subjected to reversal development copying test using a copying machine ("Model 2700" manufactured by Fuji Xerox Co., Ltd., modified for capsule toner) under a high temperature and high humidity condition (35° C., 85% RH). As a result, 20,000 copies free from fog were obtained in a stable manner.

COMPARATIVE EXAMPLE 1

A capsule toner in which acrylonitrile was graft polymerized to the outer shell was obtained in the same manner as in Example 1, except for replacing 1 g of pentafluoropropyl methacrylate as used in Example 1 with 1 g of acrylonitrile. Three grams of the resulting capsule toner and 100 g of a phenol resin-coated iron powder carrier were mixed at 20° C. and 50% RH. The amount of electricity was found to be −14 μC/g as measured by a blow-off method. When the mixing was conducted at 28° C. and 80% RH, the amount of electricity was found to be −6 μC/g.

On the other hand, 100 parts of the capsule toner were thoroughly mixed with 1 part of hydrophobic silica "R 972", and the thus prepared toner was subjected to copying test in the same manner as in Example 1. As a result, fog developed on the 1000th copy and afterwards, and the image density decreased on the 2000th copy to cause appreciable reduction in image clearness.

EXAMPLE 2

1) Preparation of Capsule Particles

In 150 g of lauryl methacrylate was dissolved 30 g of polyisobutyl methacrylate (Mw: $16\times10^4$), and 20 g of a red pigment ("Hostaperm Scarlet GO" produced by Bayer A.G.) was added thereto. The mixture was dispersed in a ball mill for 16 hours. To 200 g of the resulting dispersion were added 10 g of an isocyanate compound "Sumidur L", 5 g of toluidine diisocyanate ("Coronate T" produced by Nippon Polyurethane Co., Ltd.), and 3 g of azobisvaleronitrile, followed by thoroughly mixing. The resulting dispersion was designated liquid A.

Separately, 10 g of hydroxypropylmethyl cellulose "Metolose 65SH50" was dissolved in 250 g of deionized water, and the solution was cooled to 5° C. The resulting solution was designated liquid B.

Liquid B was agitated in an emulsifier "Autohomomixer", and liquid A was slowly poured therein to conduct emulsification thereby to obtain an O/W emulsion having oil droplets of about 12 μm in average size. The emulsion was transferred to a propeller stirrer "Three-One Motor" and stirred at 400 rpm for 10 minutes. To the mixture was added dropwise 100 g of a 2.5% aqueous solution of diethylenetriamine. After the addition, the stirring was continued at room temperature for an additional period of 2 hours to conduct encapsulation. Then, the reaction system was further allowed to react at 65° C. for 14 hours to polymerize the core substance. The reaction mixture was poured into 2 l of deionized water, thoroughly stirred, and subjected to centrifugation. After the capsule particles separated, the supernatant liquor was removed. The above-mentioned water washing operation was repeated 5 more times, and the capsule particles were finally washed with methanol to recover red capsule particles containing a soft solid substance. Deionized water was added to the capsule particles to prepare an aqueous capsule suspension having a solid content of 40%.

2) Preparation of Toner

To 125 g of the capsule suspension prepared in (1) above (capsule particles content: 50 g) was added 125 g of deionized water, and the mixture was stirred in a propeller stirrer "Three-One Motor" at 200 rpm. To the mixture were added 5 g of 1N nitric acid, 4 g of a 10% aqueous solution of cerium sulfate, and then 0.5 g of ethylene glycol dimethacrylate, and the mixture was allowed to react at 15° C. for 3 hours. After completion of the reaction, the reaction mixture was poured into 1 l of deionized water, thoroughly stirred, and subjected to centrifugation. After the capsule particles precipitated, the supernatant liquor was removed. This washing operation was repeated 2 more times to finally recover capsule particles in which ethylene glycol dimethacrylate was graft polymerized to the surface of the outer shell. The resulting capsule particles were re-suspended in deionized water and stirred in a propeller stirrer "Three-One Motor" at 200 rpm. Then, 0.4 g of potassium persulfate, 1 g of 1,1,1,3,3,3-hexafluoroisopropyl acrylate, and 0.16 g of sodium hydrogensulfite were successively added thereto, and the mixture was allowed to react at 25° C. for 3 hours. After completion of the reaction, the reaction mixture was poured into 2 l of deionized water, thoroughly stirred, and subjected to centrifugation. After the capsule particles were sedimented, the supernatant liquor was removed. This washing operation was repeated 4 more times to finally recover a capsule toner in which 1,1,1,3,3,3-hexafluoroisopropyl acrylate was graft polymerized to the surface of the outer shell. The resulting capsule suspension was spread in a stainless steel tray and dried in a drier (manufactured by Yamato Kagaku Co., Ltd.) at 60° C. for 10 hours.

3) Evaluation Test

Three grams of the resulting capsule toner and 100 g of a phenol resin-coated iron powder carrier were mixed at 20° C. and 50% RH. The amount of electricity of the capsule toner was −17 μC/g as measured by a blow-off method. When the mixing was conducted at 28° C. and 80% RH, the amount of electricity was −15 μC/g.

On the other hand, 1 part of hydrophobic silica "R 972" was added to 100 parts of the capsule toner, followed by thoroughly mixing. The thus prepared toner was subjected to copying test in the same manner as in Example 1. As a result, 20,000 copies free from fog were obtained in a stable manner.

COMPARATIVE EXAMPLE 2

A capsule toner in which methacrylic acid was graft polymerized to the outer shell was obtained in the same manner as in Example 2, except for replacing 1 g of 1,1,1,3,3,3-hexafluoroisopropyl acrylate as used in Example 2 with 1 g of methacrylic acid. Three grams of the resulting capsule toner and 100 g of a phenol resin-coated iron powder carrier were mixed at 20° C. and 50% RH. The amount of electricity was found to be −10 μC/g as measured by a blow-off method. When the mixing was conducted at 28° C. and 80% RH, the amount of electricity was found to be −4 μC/g.

On the other hand, 100 parts of the capsule toner were thoroughly mixed with 1 part of hydrophobic silica "R 972", and the thus prepared toner was subjected to copying test in the same manner as in Example 1. As a result, fog developed on the 10th copy and afterwards, and the image density decreased on the 100th copy to cause appreciable reduction in image clearness.

EXAMPLE 3

1) Preparation of Capsule Particles

In a mixture of 60 g of dibutylnaphthalene and 60 g of ethyl acetate were dissolved 30 g of polyisobutyl methacrylate (Mw: $16\times10^4$) and 40 g of a styrene-n-butyl methacrylate copolymer (Mw: $6\times10^4$). To the solution was added 120 g of a magnetic powder "EPT-1000", and the mixture was dispersed in a ball mill for 16 hours. To 200 g of the resulting dispersion were added 20 g of an isocyanate compound "Sumidur L", 5 g of toluidine diisocyanate "Coronate T", 5 g of an epoxy resin ("Epikote 801" produced by Yuka Shell Epoxy Co., Ltd.), and 24 g of ethyl acetate, followed by thoroughly mixing. The resulting dispersion was designated liquid A.

Separately, 10 g of hydroxypropylmethyl cellulose "Metolose 65SH50" was dissolved in 200 g of deionized water, and the solution was cooled to 5° C. The resulting solution was designated liquid B.

Liquid B was agitated in an emulsifier "Autohomomixer", and liquid A was slowly poured therein to conduct emulsification thereby to obtain an O/W emulsion having oil droplets of about 12 μm in average size. The emulsion was transferred to a stirrer equipped with a propeller stirring blade "Three-One Motor" and stirred at 400 rpm for 10 minutes. To the mixture was added dropwise 100 g of a 5% aqueous solution of diethylenetriamine. After the addition, the reaction system was heated to 60° C. for 3 hours to conduct encapsulation. The reaction mixture was poured into 2 l of deionized water, thoroughly stirred, and allowed to stand. After the capsule particles were sedimented, the supernatant liquor was removed. The above-mentioned water washing operation was repeated 7 more times to finally recover capsule particles containing an oily binder. Deionized water was added to the capsule particles to prepare in aqueous capsule suspension having a solid content of 40%.

2) Preparation of Toner

To 125 g of the capsule suspension prepared in (1) above (capsule particles content: 50 g) was added 125 g of deionized water, and the mixture was stirred in a propeller stirrer "Three-One Motor" at 200 rpm. To the mixture were added 5 g of 1N nitric acid, 4 g of a 10% aqueous solution of cerium sulfate, and then 0.5 g of ethylene glycol dimethacrylate, and the mixture was allowed to react at 15° C. for 3 hours. After completion of the reaction, the reaction mixture was poured into 1 l of deionized water, thoroughly stirred, and allowed to stand. After the capsule particles precipitated, the supernatant liquor was removed. This washing operation was repeated 2 more times to finally recover capsule particles in which ethylene glycol dimethacrylate was graft polymerized to the surface of the outer shell. The resulting capsule particles were re-suspended in deionized water and stirred in a propeller stirrer "Three-One Motor" at 200 rpm. Then, 0.4 g of potassium persulfate, 1.5 g of pentafluoropropyl methacrylate, and 0.16 g of sodium hydrogensulfite were successively added thereto, and the mixture was allowed to react at 25° C. for 3 hours. After completion of the reaction, the reaction mixture was poured into 2 l of deionized water, thoroughly stirred, and allowed to stand. After the capsule particles were sedimented, the supernatant liquor was removed. This washing operation was repeated 4 more times to finally recover a capsule toner in which pentafluoropropyl methacrylate was graft polymerized to the surface of the outer shell. The resulting capsule suspension was spread in a stainless steel tray and dried in a drier (manufactured by Yamato Kagaku Co., Ltd.) at 60° C. for 10 hours.

3) Evaluation Test

Three grams of the resulting capsule toner and 100 g of a phenol resin-coated iron powder carrier were mixed at 20° C. and 50% RH. The amount of electricity of the capsule toner was −15 μC/g as measured by a blow-off method. When the mixing was conducted at 28° C. and 80% RH, the amount of electricity was −12 μC/g.

On the other hand, 1 part of hydrophobic silica "R 972" was added to 100 parts of the capsule toner, followed by thoroughly mixing. The resulting toner was subjected to copying test in the same manner as in Example 1. As a result, 20,000 copies free from fog were obtained in a stable manner.

COMPARATIVE EXAMPLE 3

Three grams of fine particles of a fluorine resin ("Lubilon L-2" produced by Daikin Kogyo Co., Ltd.) having an average particle size of from 0.2 to 0.4 μm were added to 125 g of the capsule suspension obtained in Example 3 (capsule particles content: 50 g), followed by stirring. The mixture was spread over a stainless steel tray and dried in a drier (manufactured by Yamato Kagaku Co., Ltd.) at 40° C. for 20 hours to obtain a black toner having a fluorine resin on the surface thereof.

Three grams of the resulting capsule toner and 100 g of a phenol resin-coated iron powder carrier were mixed at 20° C. and 50% RH. The amount of electricity of the capsule toner was −12 μC/g as measured by a blow-off method. When the mixing was conducted at 28° C. and 80% RH, the amount of electricity was −8 μC/g.

On the other hand, 1 part of hydrophobic silica "R 972" was added to 100 parts of the capsule toner, followed by thoroughly mixing. The resulting toner was subjected to copying test in the same manner as in Example 1. As a result, fog developed on the 2000th copy and afterwards, and the image density decreased on the 2500th copy to cause appreciable reduction in image clearness.

EXAMPLE 4

1) Preparation of Capsule Particles

In a mixture of 60 g of dibutylnaphthalene and 60 g of ethyl acetate were dissolved 30 g of polyisobutyl methacrylate (weight-average molecular weight (Mw): $16\times10^4$) and 40 g of a styrene-n-butyl methacrylate copolymer (Mw: $6\times10^4$). To the solution was added 120 g of a magnetic powder ("EPT-1000" produced by Toda Kogyo Corp.), and the mixture was dispersed in a ball mill for 16 hours. To 200 g of the resulting dispersion were added 30 g of an isocyanate compound ("Sumidur L" produced by Sumitomo Bayer Urethane Co., Ltd.) and 24 g of ethyl acetate, followed by thoroughly mixing. The resulting dispersion was designated liquid A.

Separately, 10 g of hydroxypropylmethyl cellulose ("Metolose 65SH50" produced by Shin-Etsu Chemical Co., Ltd.) was dissolved in 200 g of deionized water, and the solution was cooled to 5° C. The resulting solution was designated liquid B.

Liquid B was agitated in an emulsifier ("Autohomomixer" manufactured by Tokukikako K.K.), and liquid A was slowly poured therein to conduct emulsification thereby to obtain an O/W emulsion having oil droplets of about 12 μm in average size. The emulsion was transferred to a stirrer equipped with a propeller stirring blade ("Three-One Motor" manufactured by Shinto Kagaku Co., Ltd.) and stirred at 400 rpm for 10 minutes. To the mixture was added dropwise 100 g of a 5% aqueous solution of diethylenetriamine, and the mixture was then heated to 60° C. to conduct an encapsulation reaction for 3 hours. After completion of the reaction, the reaction system was poured into 2 l of deionized water, and the mixture was stirred thoroughly, followed by allowing to stand. After the capsule particles precipitated, the supernatant liquor was removed. The above-mentioned washing operation was repeated 7 more times to finally recover capsule particles containing an oily binder. Deionized water was added to the capsule particles to prepare an aqueous capsule suspension having a solid content of 40%.

2) Preparation of Toner

To 125 g of the capsule suspension prepared in (1) above (capsule particles content: 50 g) was added 125 g of deionized water, and the mixture was stirred in a propeller stirrer "Three-One Motor" at 200 rpm. To the mixture were added 5 g of 1N nitric acid, 4 g of a 10% aqueous solution of cerium sulfate, and then 1 g of ethylene glycol dimethacrylate, and the mixture was allowed to react at 15° C. for 3 hours. After completion of the reaction, the reaction mixture was poured into 1 l of deionized water, thoroughly stirred, and allowed to stand. After the capsule particles precipitated, the supernatant liquor was removed. This washing operation was repeated 2 more times to finally recover capsule particles in which ethylene glycol dimethacrylate was graft polymerized to the surface of the outer shell. The resulting capsule particles were re-suspended in deionized water and stirred in a propeller stirrer "Three-One Motor" at 200 rpm. Then, 0.4 g of potassium persulfate, 2 g of trifluoroethyl methacrylate, and 0.16 g of sodium hydrogensulfite were successively added thereto, and the mixture was allowed to react at 25° C. for 3 hours. After completion of the reaction, the reaction mixture was poured into 2 l of deionized water, thoroughly stirred, and allowed to stand. After the capsule particles were sedimented, the supernatant liquor was removed. This washing operation was repeated 4 more times to finally recover a capsule toner in which trifluoroethyl methacrylate was graft polymerized to the surface of the outer shell. The resulting capsule suspension was mixed with 0.15 g of carbon black ("Regal 330R" produced by Cabot Corporation) dispersed in water, and then spread in a stainless steel tray and dried in a drier (manufactured by Yamato Kagaku Co., Ltd.) at 60° C. for 10 hours.

3) Evaluation Test

Three grams of the resulting capsule toner and 100 g of a phenol resin-coated iron powder carrier were mixed at 20° C. and 50% RH. The amount of electricity of the capsule toner was $-19$ $\mu$C/g as measured by a blow-off method. When the mixing was conducted at 28° C. and 80% RH, the amount of electricity was $-18$ $\mu$C/g with a sharp distribution.

On the other hand, the resulting capsule toner was subjected to copying test in the environmental conditions of 20° C. and 50% RH by means of the same copying machine as used in Example 1. As a result, 20000 copies free from fog were obtained in a stable manner. When the same copying test was conducted under a low temperature and low humidity condition (10° C., 15% RH), 30000 satisfactory copies were obtained in a stable manner.

EXAMPLE 5

1) Preparation of Capsule Particles

In 150 g of lauryl methacrylate was dissolved 30 g of polyisobutyl methacrylate (Mw: $16\times10^4$), and 20 g of a red pigment ("Hostaperm Scarlet GO" produced by Bayer A.G.) was added thereto. The mixture was dispersed in a ball mill for 16 hours. To 200 g of the resulting dispersion were added 10 g of an isocyanate compound "Sumidur L", 5 g of toluidine diisocyanate ("Coronate T" produced by Nippon Polyurethane Co., Ltd.), and 3 g of azobisvaleronitrile, followed by thoroughly mixing. The resulting dispersion was designated liquid A.

Separately, 10 g of hydroxypropylmethyl cellulose "Metolose 65SH50" was dissolved in 250 g of deionized water, and the solution was cooled to 5° C. The resulting solution was designated liquid B.

Liquid B was agitated in an emulsifier "Autohomomixer", and liquid A was slowly poured therein to conduct emulsification thereby to obtain an O/W emulsion having oil droplets of about 12 $\mu$m in average size. The emulsion was transferred to a propeller stirrer "Three-One Motor" and stirred at 400 rpm for 10 minutes. To the mixture was added dropwise 100 g of a 2.5% aqueous solution of diethylenetriamine. After the addition, the stirring was continued at room temperature for an additional period of 2 hours to conduct encapsulation. Then, the reaction system was further allowed to react at 65° C. for 14 hours to polymerize the core substance. The reaction mixture was poured into 2 l of deionized water, thoroughly stirred, and subjected to centrifugation. After the capsule particles separated, the supernatant liquor was removed. The above-mentioned water washing operation was repeated 5 more times, and the capsule particles were finally washed with methanol to recover red capsule particles containing a soft solid substance. Deionized water was added to the capsule particles to prepare an aqueous capsule suspension having a solid content of 40%.

2) Preparation of Toner

To 125 g of the capsule suspension prepared in (1) above (capsule particles content: 50 g) was added 125 g of deionized water, and the mixture was stirred in a propeller stirrer "Three-One Motor" at 200 rpm. To the mixture were added 5 g of 1N nitric acid, 4 g of a 10% aqueous solution of cerium sulfate, and then 1 g of ethylene glycol dimethacrylate, and the mixture was allowed to react at 15° C. for 3 hours. After completion of the reaction, the reaction mixture was poured into 1 l of deionized water, thoroughly stirred, and subjected to centrifugation. After the capsule particles precipitated, the supernatant liquor was removed. This washing operation was repeated 2 more times to finally recover capsule particles in which ethylene glycol dimethacrylate was graft polymerized to the surface of the outer shell. The resulting capsule particles were re-suspended in deionized water and stirred in a propeller stirrer "Three-One Motor" at 200 rpm. Then, 0.4 g of potassium persulfate, 2 g of 1,1,1,3,3,3-hexafluoroisopropyl acrylate, and 0.16 g of sodium hydrogensulfite were successively added thereto, and the mixture was allowed to react at 25° C. for 3 hours. After completion of the reaction, the reaction mixture was poured into 2 l of deionized water, thoroughly stirred, and subjected to centrifugation. After the capsule particles were sedimented, the supernatant liquor was removed. This washing operation was repeated 4 more times to finally recover a capsule toner in which 1,1,1,3,3,3-hexafluoroisopropyl acrylate was graft polymerized to the surface of the outer shell. The resulting capsule suspension was mixed with 0.4 g of tin oxide ("S1" produced by Mitsubishi Material Co., Ltd.) dispersed in water, and then spread in a stainless steel tray and dried in a drier (manufactured by Yamato Kagaku Co., Ltd.) at 60° C. for 10 hours.

3) Evaluation Test

Three grams of the resulting capsule toner and 100 g of a phenol resin-coated iron powder carrier were mixed at 20° C. and 50% RH. The capsule toner had a charge amount of $-16$ μC/g with a sharp distribution as measured by a blow-off method. When the mixing was conducted at 28° C. and 80% RH, the amount of electricity was $-15$ μC/g with a sharp distribution.

On the other had, the resulting capsule toner was subjected to copying test in the same manner as in Example 4. As a result, 20000 copies free from fog were obtained in a stable manner under the condition of 20° C., 50% RH, and 30000 satisfactory copies were obtained in a stable manner under the condition of 10° C., 15% RH.

EXAMPLE 6

1) Preparation of Capsule Particles

In a mixture of 60 g of dibutylnaphthalene and 60 g of ethyl acetate were dissolved 30 g of polyisobutyl methacrylate (Mw: $16\times10^4$) and 40 g of a styrene-n-butyl methacrylate copolymer (Mw: $6\times10^4$). To the solution was added 120 g of a magnetic powder "EPT-1000", and the mixture was dispersed in a ball mill for 16 hours. To 200 g of the resulting dispersion were added 20 g of an isocyanate compound "Sumidur L", 5 g of toluidine diisocyanate "Coronate T", 5 g of an epoxy resin ("Epikote 801" produced by Yuka Shell Epoxy Co., Ltd.), and 24 g of ethyl acetate, followed by thoroughly mixing. The resulting dispersion was designated liquid A.

Separately, 10 g of hydroxypropylmethyl cellulose "Metolose 65SH50" was dissolved in 200 g of deionized water, and the solution was cooled to 5° C. The resulting solution was designated liquid B.

Liquid B was agitated in an emulsifier "Autohomomixer", and liquid A was slowly poured therein to conduct emulsification thereby to obtain an O/W emulsion having oil droplets of about 12 μm in average size. The emulsion was transferred to a stirrer equipped with a propeller stirring blade "Three-One Motor" and stirred at 400 rpm for 10 minutes. To the mixture was added dropwise 100 g of a 5% aqueous solution of diethylenetriamine. After the addition, the reaction system was heated to 60° C. for 3 hours to conduct encapsulation. The reaction mixture was poured into 2 l of deionized water, thoroughly stirred, and allowed to stand. After the capsule particles were sedimented, the supernatant liquor was removed. The above-mentioned water washing operation was repeated 7 more times to finally recover capsule particles containing an oily binder. Deionized water was added to the capsule particles to prepare an aqueous capsule suspension having a solid content of 40%.

2) Preparation of Toner

To 125 g of the capsule suspension prepared in (1) above (capsule particles content: 50 g) was added 125 g of deionized water, and the mixture was stirred in a propeller stirrer "Three-One Motor" at 200 rpm. To the mixture were added 5 g of 1N nitric acid, 4 g of a 10% aqueous solution of cerium sulfate, and then 1 g of ethylene glycol dimethacrylate, and the mixture was allowed to react at 15° C. for 3 hours. After completion of the reaction, the reaction mixture was poured into 1 l of deionized water, thoroughly stirred, and allowed to stand. After the capsule particles precipitated, the supernatant liquor was removed. This washing operation was repeated 2 more times to finally recover capsule particles in which ethylene glycol dimethacrylate was graft polymerized to the surface of the outer shell. The resulting capsule particles were re-suspended in deionized water and stirred in a propeller stirrer "Three-One Motor" at 200 rpm. Then, 0.4 g of potassium persulfate, 3 g of pentafluoropropyl methacrylate, and 0.16 g of sodium hydrogensulfite were successively added thereto, and the mixture was allowed to react at 25° C. for 3 hours. After completion of the reaction, the reaction mixture was poured into 2 l of deionized water, thoroughly stirred, and allowed to stand. After the capsule particles were sedimented, the supernatant liquor was removed. This washing operation was repeated 4 more times to finally recover a capsule toner in which pentafluoropropyl methacrylate was graft polymerized to the surface of the outer shell.

The capsule toner suspension as obtained was spray dried. The resulting capsule toner particles were mixed with 0.4 g of tin oxide ("S1" produced by Mitsubishi Metal Mining Co., Ltd.) and 0.3 g of hydrophobic silica "R 972" in a twin-cylinder mixer (through-view type mixer manufactured by Tsutsui Rikagaku Kikai K.K.) for 12 hours.

3) Evaluation Test

Three grams of the resulting capsule toner and 100 g of a phenol resin-coated iron powder carrier were mixed at 20° C. and 50% RH. The amount of electricity of the capsule toner was $-15$ μC/g as measured by a blow-off method. When the mixing was conducted at 28° C. and 80% RH, the amount of electricity was $-14$ μC/g with a sharp distribution.

On the other hand, the thus prepared toner was subjected to copying test in the same manner as in Example 4. As a result, 20000 copies free from fog were obtained in a stable manner under the condition of 20° C., 50% RH, and 30000 satisfactory copies were obtained in a stable manner under the condition of 10° C., 15% RH.

As described above, the electrophotographic toner according to the present invention, in which a polymer comprising a specific fluorine-containing vinyl monomer unit is adhered on the surface of toner particles, exhibits negative chargeability with narrow charge distribution with satisfactory environmental stability. Further, the toner suffers from no impairment of chargeability by mechanical forces so that is stably provides copies of excellent image quality for a prolonged period of time. Furthermore, the toner of the invention can be produced with a wide choice of materials and without requiring any special reaction apparatus. The capsule toner having adhered thereto conductive fine particles exhibits improved cleaning properties to provide satisfactory copies even under a low temperature and low humidity condition.

While the invention has been described in detail and with reference to specific examples thereof, it will be apparent to one skilled in the art that various changes and modifications can be made therein without departing from the spirit and scope thereof.

What is claimed is:

1. An electrophotographic toner comprising toner particles having adhered on the surface thereof a polymer comprising at least 5 mol % of a monomer unit derived from a fluorine-containing vinyl monomer represented by formula (I) or (II):

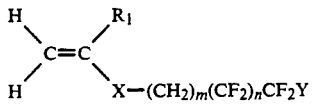

(I)

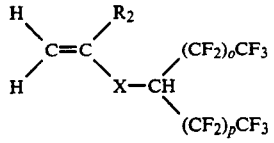

(II)

wherein X represents COO, OCO, O, or a p-phenylene group; $R_1$ and $R_2$ each represent a hydrogen atom or an alkyl group having from 1 to 3 carbon atoms; m represents an integer of from 1 to 7; n represents an integer of from 1 to 19, o and p each represent an integer of from 0 to 7; and Y represents a hydrogen atom or a fluorine atom.

2. An electrophotographic toner as claimed in claim 1, wherein said fluorine-containing vinyl monomer is pentafluoropropyl methacrylate or 1,1,1,3,3,3-hexafluoroisopropyl acrylate.

3. An electrophotographic toner as claimed in claim 1, wherein said polymer contains at least 10 mol % of the monomer unit derived from said fluorine-containing vinyl monomer.

4. An electrophotographic toner as claimed in claim 1, wherein said polymer is present in an amount of from 0.1 to 20 parts by weight per 100 parts by weight of the toner particles.

5. An electrophotographic toner as claimed in claim 1, wherein said polymer is chemically bonded to the surface of the toner particles.

6. An electrophotographic toner as claimed in claim 1, wherein said toner particles are capsule toner particles.

7. An electrophotographic toner as claimed in claim 1, wherein said toner particles have a substance capable of forming a radical on the surface thereof.

8. An electrophotographic toner comprising capsule toner particles having adhered on the surface thereof (a) a polymer comprising at least 5 mol % of a monomer unit derived from a fluorine-containing vinyl monomer represented by formula (I) or (II):

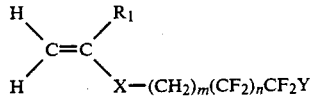

(I)

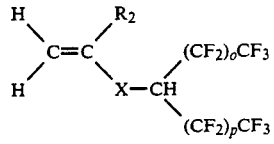

(II)

wherein X represents COO, OCO, O, or a p-phenylene group; $R_1$ and $R_2$ each represent a hydrogen atom or an alkyl group having from 1 to 3 carbon atoms; m represents an integer of from 1 to 7; n represents an integer of from 1 to 19, o and p each represent an integer of from 0 to 7; and Y represents a hydrogen atom or a fluorine atom; and (b) conductive fine particles.

9. An electrophotographic toner as claimed in claim 8, wherein said conductive fine particles are fine particles of carbon black, tin oxide, or titanium oxide.

10. An electrophotographic toner as claimed in claim 8, wherein said conductive fine particles are present in an amount of from 0.01 to 5 parts by weight per 100 parts by weight of the capsule toner particles.

11. A process for producing an electrophotographic toner comprising graft polymerizing a monomer having at least two radical chain transfer groups on the toner particles having thereon a substance capable of forming a radical and then radical polymerizing at least 5 mol % of a fluorine-containing vinyl monomer represented by formula (I) or (II):

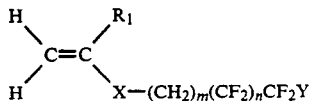

(I)

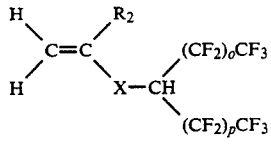

(II)

wherein X represents COO, OCO, O, or a p-phenylene group; $R_1$ and $R_2$ each represent a hydrogen atom or an alkyl group having from 1 to 3 carbon atoms; m represents an integer of from 1 to 7; n represents an integer of from 1 to 19, o and p each represent an integer of from 0 to 7; and Y represents a hydrogen atom or a fluorine atom, or a mixture of said monomer represented by formula (I) or (II) and a copolymerizable monomer.

12. An electrophotographic toner comprising toner particles having adhered on the surface thereof a polymer comprising at least 5 mol % of a monomer unit derived from a fluorine-containing vinyl monomer represented by formula (I) or (II):

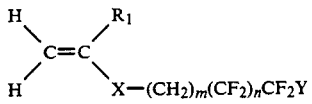

(I)

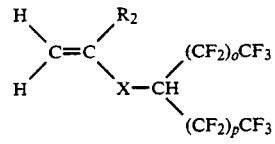

(II)

wherein X represents COO or a p-phenylene group; $R_1$ and $R_2$ each represent a hydrogen atom or an alkyl group having from 1 to 3 carbon atoms; m represents an integer of from 1 to 7; n represents an integer of from 1 to 19, o and p each represent an integer of from 0 to 7; and Y represents a hydrogen atom or a fluorine atom.

13. An electrophotographic toner comprising capsule toner particles having adhered on the surface thereof (a) a polymer comprising at least 5 mol % of a monomer unit derived form a fluorine-containing vinyl monomer represented by formula (I) or (II):

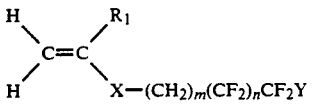

(I)

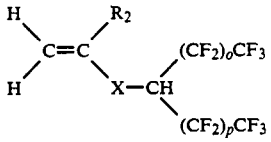

(II)

wherein X represents COO or a p-phenylene group; $R_1$ and $R_2$ each represent a hydrogen atom or an alkyl group having from 1 to 3 carbon atoms; m represents an integer of from 1 to 7; n represents an integer of from 1 to 19, o and p each represent an integer of from 0 to 7; and Y represents a hydrogen atom or a fluorine atom; and (b) conductive fine particles.

14. A process for producing an electrophotographic toner comprising graft polymerizing a monomer having at least two radical chain transfer groups on the toner particles having thereon a substance capable of forming a radical and then radical polymerizing at least 5 mol % of a fluorine-containing vinyl monomer represented by formula (I) or (II):

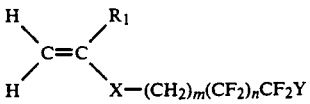

(I)

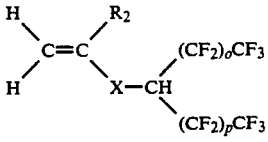

(II)

wherein X represents COO or a p-phenylene group; $R_1$ and $R_2$ each represent a hydrogen atom or an alkyl group having from 1 to 3 carbon atoms; m represents an integer of from 1 to 7; n represents an integer of from 1 to 19, o and p each represent an integer of from 0 to 7; and Y represents a hydrogen atom or a fluorine atom, or a mixture of said monomer represented by formula (I) or (II) and a copolymerizable monomer.

* * * * *